US011247119B2

(12) United States Patent
Chen et al.

(10) Patent No.: US 11,247,119 B2
(45) Date of Patent: Feb. 15, 2022

(54) SOMATOSENSORY ELECTRONIC PUZZLE

(71) Applicant: Shenzhen Polytechnic, Shenzhen (CN)

(72) Inventors: Meifen Chen, Shenzhen (CN); Bo Wu, Shenzhen (CN)

(73) Assignee: Shenzhen Polytechnic, Guangdon (CN)

( * ) Notice: Subject to any disclaimer, the term of this patent is extended or adjusted under 35 U.S.C. 154(b) by 0 days.

(21) Appl. No.: 16/998,343

(22) Filed: Aug. 20, 2020

(65) Prior Publication Data

US 2021/0052973 A1 Feb. 25, 2021

(30) Foreign Application Priority Data

Aug. 20, 2019 (CN) ..... 201910771120.4

(51) Int. Cl.
*A63F 9/10* (2006.01)
*A63F 9/00* (2006.01)

(52) U.S. Cl.
CPC .... *A63F 9/1044* (2013.01); *A63F 2009/0087* (2013.01); *A63F 2009/1022* (2013.01); *A63F 2009/1061* (2013.01); *A63F 2250/0407* (2013.01)

(58) Field of Classification Search
CPC ..... A63F 9/1044; A63F 2009/0087; A63F 2009/1022; A63F 2009/1061; A63F 2250/0407; A63F 9/0612; A63F 2009/2402; A63F 2003/00826; A63F 2009/2454; A63F 2009/2486; A63F 2250/0428; A63F 2250/021
See application file for complete search history.

(56) References Cited

U.S. PATENT DOCUMENTS 4,392,651 A * 7/1983 Hall ..... A63F 9/24 273/153 R
4,891,030 A * 1/1990 Gertzfeld ..... A63F 9/10 446/118
5,555,163 A * 9/1996 Pisani ..... G09F 13/28 362/231
5,640,931 A * 6/1997 Markham ..... A01K 15/025 119/711

(Continued)

FOREIGN PATENT DOCUMENTS

CN 109966731 A * 7/2019
CN 110523074 A * 12/2019

*Primary Examiner* — Steven B Wong
(74) *Attorney, Agent, or Firm* — Cooper Legal Group, LLC

(57) ABSTRACT

A somatosensory electronic puzzle comprises a puzzle base and puzzle blocks. The puzzle blocks are detachably connected to the puzzle base. The puzzle base comprises a bottom plate and a frame. The frame is disposed with a control module and a storage module for storing a graphic code, and an outer surface of the frame is disposed with a function selection switch. The function selection switch is connected to an input terminal of the control module. The puzzle blocks comprise a combination of one or more light-emitting puzzle blocks, a wind generating puzzle block, a smell generating puzzle block, a rain generating puzzle block, a tree puzzle block, a lightning and thunder generating puzzle block, a person puzzle block, or an animal puzzle block. The one or more light-emitting puzzle blocks comprise a puzzle block comprising a constant color and a puzzle block comprising variable colors.

12 Claims, 14 Drawing Sheets

(56) References Cited

U.S. PATENT DOCUMENTS

| | | | | |
|---|---|---|---|---|
| 7,214,118 | B1 * | 5/2007 | Maxim | A63H 33/22 362/249.14 |
| 2012/0088562 | A1 * | 4/2012 | Mohammed | A63F 9/0612 463/9 |
| 2014/0370950 | A1 * | 12/2014 | Hansson | A63F 13/57 463/9 |
| 2016/0151703 | A1 * | 6/2016 | Lee | A63F 13/426 463/9 |
| 2021/0038972 | A1 * | 2/2021 | Lin | A63F 9/0613 |
| 2021/0170265 | A1 * | 6/2021 | Curran | A63F 9/24 |
| 2021/0197071 | A1 * | 7/2021 | Bubnjic | A63H 1/00 |

* cited by examiner

SOMATOSENSORY ELECTRONIC PUZZLE

RELATED APPLICATIONS

This application claims priority to Chinese Patent Application 201910771120.4, filed on Aug. 20, 2019. Chinese Patent Application 201910771120.4 is incorporated herein by reference.

FIELD OF THE DISCLOSURE

The present disclosure relates to a somatosensory electronic puzzle.

BACKGROUND OF THE DISCLOSURE

Puzzles are very popular toys. At present, most puzzles are planar puzzles. Finished products of conventional puzzles are unchangeable due to the content displayed on puzzle blocks being unchangeable. Exploration and interest in building a puzzle is lost after several attempts, resulting in economy and practicality of a puzzle being not reflected. At the same time, existing planar puzzles lack interactivity due to constant graphics.

BRIEF SUMMARY OF THE DISCLOSURE

The present disclosure provides a somatosensory electronic puzzle to solve the deficiencies of the existing techniques.

In order to solve the aforementioned technical problems, a technical solution of the present disclosure is as follows.

A somatosensory electronic puzzle comprises a puzzle base and a plurality of puzzle blocks. The plurality of puzzle blocks are detachably connected to the puzzle base. The puzzle base comprises a bottom plate and a frame. An inner side of the frame is disposed with a control module and a storage module for storing a graphic code, and an outer surface of the frame is disposed with a function selection switch. The function selection switch is connected to an input terminal of the control module. The plurality of puzzle blocks comprise a combination of one or more light-emitting puzzle blocks, a wind generating puzzle block, a smell generating puzzle block, a rain generating puzzle block, a tree puzzle block, a lightning and thunder generating puzzle block, a person puzzle block, or an animal puzzle block. The one or more light-emitting puzzle blocks comprise a puzzle block comprising a constant color and a puzzle block comprising variable colors. The puzzle block comprising the constant color comprises a first light emitting diode (LED) lamp. The puzzle block comprising variable colors comprises first three-primary-color LED lamps and an LED drive module, and the LED drive module controls the first three-primary-color LED lamps. The wind generating puzzle block comprises one or more first fans. An inner side of the smell generating puzzle block is disposed with a spice groove for storing spices, and an outer side of the smell generating puzzle block is disposed with a first atomizing nozzle connected to the spice groove. An inner side of the rain generating puzzle block is disposed with a water groove for storing water, and an outer side of the rain generating puzzle block is disposed with a second atomizing nozzle connected to the water groove. The tree puzzle block comprises a light-transmissive tree-shaped shell. An inner side of the light-transmissive tree-shaped shell is disposed with second three-primary-color LED lamps and a gradient LED drive module, and the gradient LED drive module is connected to the second three-primary-color LED lamps. The lightning and thunder generating puzzle block comprises an electric discharge switch and an electric discharge electrode, and the electric discharge switch controls the electric discharge electrode to discharge electricity to simulate lightning and thunder. The person puzzle block comprises a light-transmitting person-shaped shell and a second LED lamp disposed in the light-transmitting person-shaped shell. The animal puzzle block comprises a light-transmitting animal-shaped shell and a third LED lamp disposed in the light-transmitting animal-shaped shell. The puzzle base comprises a plurality of joint interfaces. The plurality of joint interfaces each comprises a first positioning protrusion column comprising a positioning protrusion. An outer side wall of the first positioning protrusion column is disposed with a first negative electrode, a first control input electrode, and a first control output electrode. A top end surface of the first positioning protrusion column comprises a first positioning groove, and a first positive electrode is disposed in the first positioning groove. The plurality of puzzle blocks each comprises a second positioning groove corresponding to a corresponding one of the first positioning protrusion columns. An inner side wall of each of the second positioning grooves is disposed with a second negative electrode, a second control input electrode, and a second control output electrode. A bottom surface of each of the second positioning grooves is disposed with a second positioning protrusion column corresponding to a corresponding one of the first positioning grooves. A second positive electrode is disposed on the second positioning protrusion column, and the second positioning grooves each comprises a positioning opening corresponding to a corresponding one of the positioning protrusions. The plurality of puzzle blocks is connected to the puzzle base through the plurality of joint interfaces. The first negative electrode contacts the second negative electrode, the first control output electrode contacts the second control output electrode, the first control input electrode contacts the second control input electrode, and the first positive electrode contacts the second positive electrode to achieve at least one of power supply or signal transmission.

In another preferred embodiment, the puzzle base further comprises an audio module, and the control module drives the audio module to play audio.

In another preferred embodiment, the control module is a Bluetooth chip with a universal serial bus (USB) interface, and the Bluetooth chip is configured to be connected to an external device through the USB interface or Bluetooth to update the graphic code.

In another preferred embodiment, the wind generating puzzle block further comprises an air inlet, an air outlet, a temperature control chip, a semiconductor cooler, an adjustment switch, and cold-and-hot selection switches. The semiconductor cooler is disposed between the air inlet and the air outlet. The one or more first fans comprise a cool air fan and a hot air fan. The temperature control chip drives the semiconductor cooler. The cool air fan is disposed on a cold surface of the semiconductor cooler, and the hot air fan is disposed on a hot surface of the semiconductor cooler. The adjustment switch is connected to the temperature control chip for temperature adjustment. The cold-and-hot selection switches are respectively connected to the cool air fan and the hot air fan.

In another preferred embodiment, the inner side of the smell generating puzzle block is disposed with a first atomizer, and the inner side of the rain generating puzzle block is disposed a second atomizer. The first atomizer atomizes the spices to generate atomized spices, and the second atomizer atomizes the water to generate atomized water. The atomized spices spray out of the first atomizing nozzle using a second fan, and the atomized water sprays out of the second atomizing nozzle using the second fan.

In another preferred embodiment, the lightning and thunder generating puzzle block further comprises a 555 timer, a step-up transformer, and a voltage-multiplier and rectifier circuit. The 555 timer defines a multivibrator. An output terminal of the 555 timer is connected to an input terminal of the step-up transformer, an output terminal of the step-up transformer is connected to an input terminal of the voltage-multiplier and rectifier circuit, and an output terminal of the voltage-multiplier and rectifier circuit is connected to the electric discharge electrode to discharge electricity.

In another preferred embodiment, the lightning and thunder generating puzzle block further comprises a transparent safety cover, and the transparent safety cover surrounds the electric discharge electrode.

In another preferred embodiment, the tree puzzle block further comprises a season selection switch, and the season selection switch is connected to an input terminal of the gradient LED drive module to control an initial color of the second three-primary-color LED lamps.

In another preferred embodiment, the plurality of puzzle blocks each comprises an image part and a plug part disposed in a vertical direction. The image part is light-emitting parts of the one or more light-emitting puzzle blocks, a wind generating part of the wind generating puzzle block, a smell generating part of the smell generating puzzle block, a rain generating part of the rain generating puzzle block, a tree-image part of the tree puzzle block, a lightning and thunder generating part of the lightning and thunder generating puzzle block, a person image part of the person puzzle block, or an animal image part of the animal puzzle block. The plug parts each cooperates with a corresponding one of the joint interfaces, and the plug parts each comprises a corresponding one of the second positioning grooves.

In another preferred embodiment, the plurality of puzzle blocks each comprises a single plug part or two or more plug parts.

In another preferred embodiment, the plurality of puzzle blocks further comprise a general extension block.

In another preferred embodiment, a shaft center of the top end surface of the first positioning protrusion column comprises the first positioning groove.

Compared with existing techniques, the technical solution provided by the present disclosure has the following advantages.

1. The puzzle block comprising variable colors can display different patterns according to the graphic code stored in the puzzle base. Replacing the puzzle blocks comprising variable colors with other puzzle blocks can simulate different natural scenes. The wind generating puzzle block, the smell generating puzzle block, the rain generating puzzle block, the tree puzzle block, the lightning and thunder generating puzzle block, the person puzzle block, and the animal puzzle block can cooperate with each other to simulate various natural phenomena in nature. By choosing different puzzle blocks, a child's imagination and creativity can be developed and young children can experience different natural environments. The plurality of puzzle blocks can be installed on the puzzle base through the plurality of joint interfaces. The positioning protrusions and the positioning opening cooperate with each other to determine the accuracy of the joint and avoiding the wrong contact of the electrodes. The first positive electrode is disposed in the first positioning groove to prevent accidental touch.

2. The audio module plays audio according to the puzzle pattern. With the audio, children can perceive the natural characteristics of seasonal changes.

3. The Bluetooth chip with USB interface can be used to update the graphic code through a USB interface or Bluetooth connection with external smart devices.

4. The semiconductor cooler cooperates with the fan, the fan can blow out cold or hot air to simulate the wind in nature. Temperature adjustment input can be realized by adjusting the adjustment switch, and the cool air fan or hot air fan can be selected to be turned on by the cold-and-hot selection switch.

5. By setting the first atomizer and the second atomizer, the spices and water can be atomized and sprayed out.

6. Boosting the output of the 555 timer and discharging the output through an electric discharge electrode can simulate natural lightning and thunder.

7. The transparent safety cover to wrap the electric discharge electrode can improve safety.

8. Through the season selection switch, the initial colors of the second three-primary-color LED lamps are controlled to simulate the color of trees to realize trees in different simulated seasons.

BRIEF DESCRIPTION OF THE DRAWING

The present disclosure will be further described below with the combination of the accompanying drawings and the embodiments. However, the somatosensory electronic puzzle of the present disclosure is not limited to the embodiments.

DETAILED DESCRIPTION OF THE EMBODIMENTS

Figure 1:
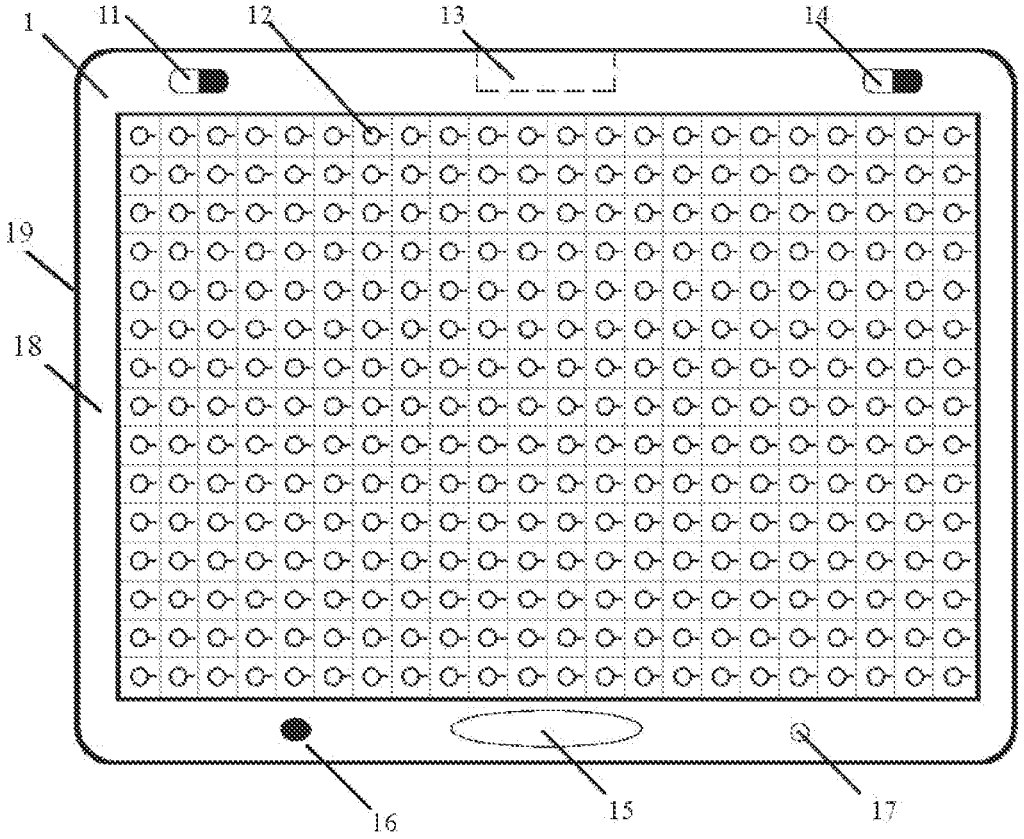
FIG. 1 illustrates a top view of a structure of a puzzle base of an embodiment of the present disclosure.
Figure 2:
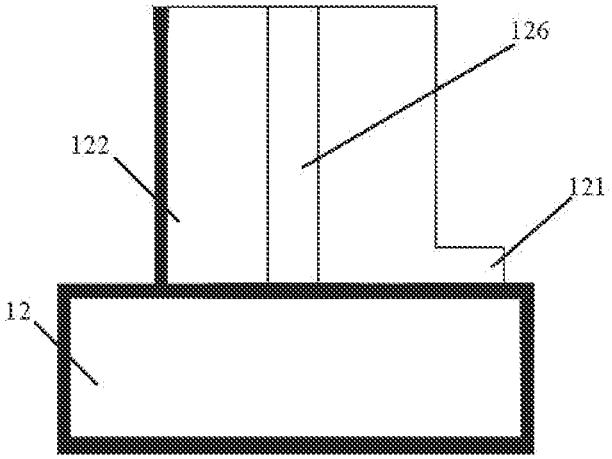
FIG. 2 illustrates a cross-sectional view of a joint interface of the puzzle base of the embodiment of the present disclosure.
Figure 3:
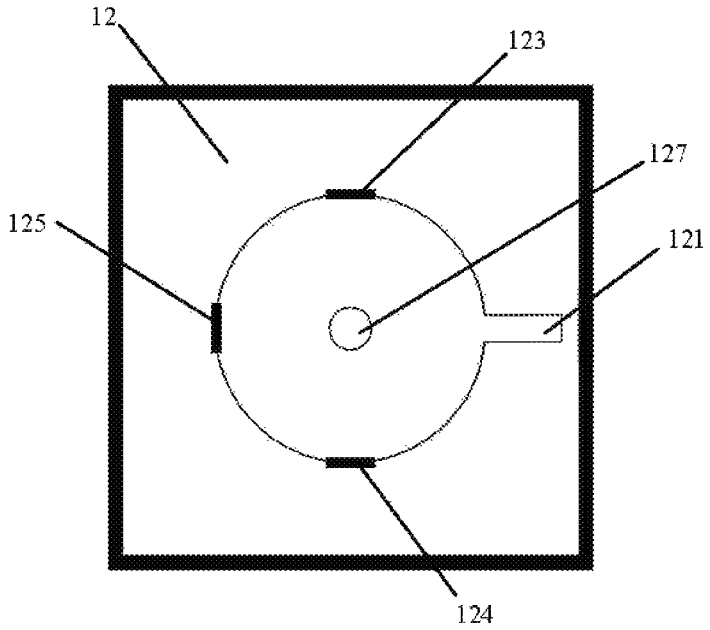
FIG. 3 illustrates a top view of the joint interface of the puzzle base of the embodiment of the present disclosure.
Figure 4:
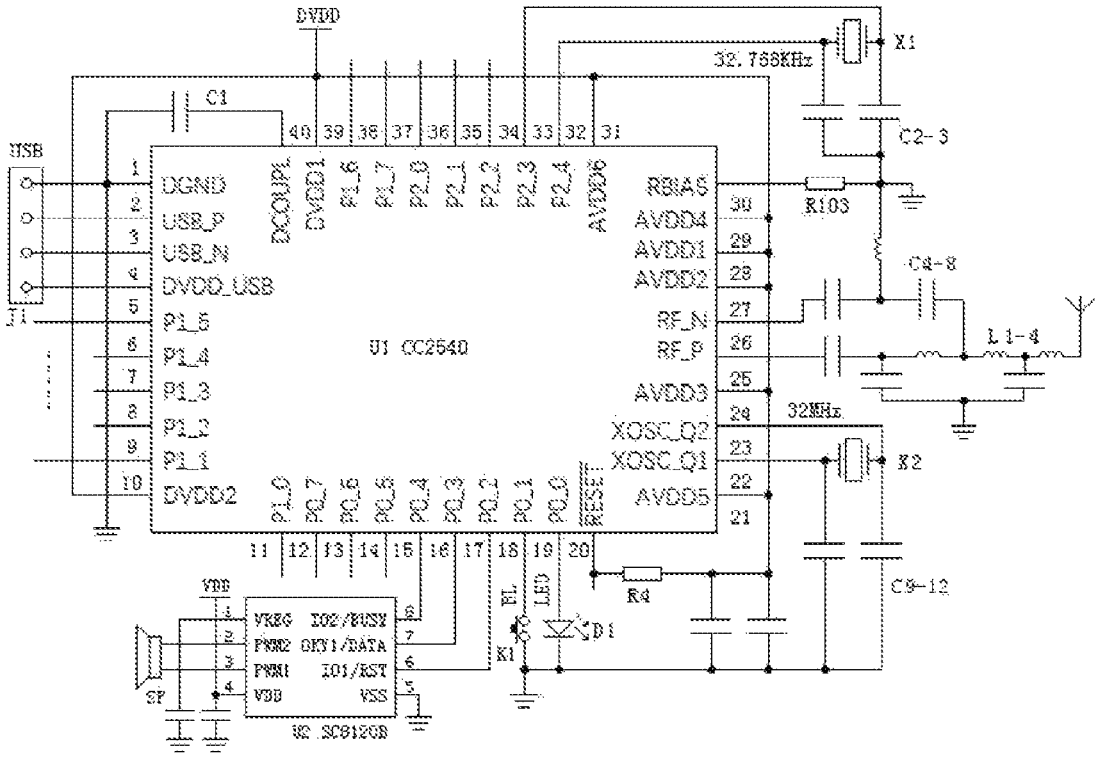
FIG. 4 illustrates a circuit diagram of the puzzle base of the embodiment of the present disclosure.

Referring to FIGS. 1-28, a somatosensory electronic puzzle comprises a puzzle base 1 and a plurality of puzzle blocks 20. The plurality of puzzle blocks 20 are detachably connected to the puzzle base 1 through a plurality of joint interfaces 12. The puzzle base 1 comprises a bottom plate 19 and a frame 18. An inner side of the frame 18 is disposed with a Bluetooth control module U1 with an internal memory and an audio module U2. The internal memory is used to store graphic codes, and an outer surface of the frame 18 is disposed with a function selection switch 11, a universal serial bus (USB) interface 13, a power switch 14, a speaker 15, a code pairing switch 16, and an indicator light 17. The function selection switch 11 is connected to an input terminal of the Bluetooth control module U1, and the Bluetooth control module U1 drives the audio module U2 to control the speaker 15 to play audio. The function selection switch 11 is used to selectively send or receive the graphic codes, and the USB interface 13, the power switch 14, the code pairing switch 16, and the indicator light 17 are electrically connected to Bluetooth control module U1. The USB interface 13 is used to receive the graphic codes, the power switch 14 is used to control a power supply of the puzzle base 1, the code pairing switch 16 is used for Bluetooth pairing, and the indicator light 17 is used to indicate a working status of the puzzle base 1.

Referring to FIGS. 1-4, the puzzle base 1 is disposed with the plurality of joint interfaces 12. The plurality of joint interfaces 12 each comprises a first positioning protrusion column 122 with a positioning protrusion 121. An outer wall of the first positioning protrusion column 122 is disposed with a first negative electrode 123, a first control input electrode 124, and a first control output electrode 125. A shaft center of a top end surface of the first positioning protrusion column 122 comprises a first positioning groove 126, and a first positive electrode 127 is disposed in the first positioning groove 126.

Figure 5:
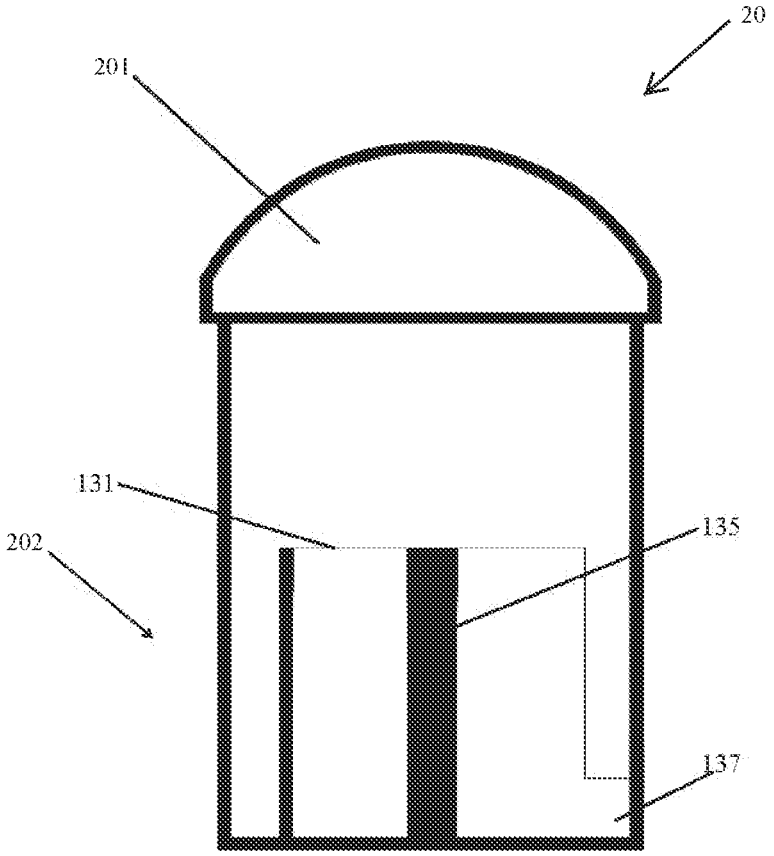
FIG. 5 illustrates a cross-sectional view of a puzzle block comprising variable colors of the embodiment of the present disclosure.
Figure 6:
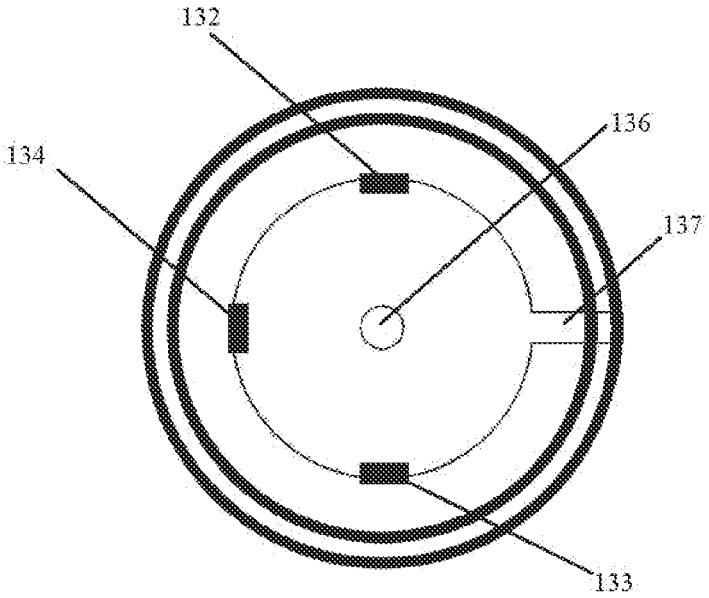
FIG. 6 illustrates a bottom view of the puzzle block comprising the variable colors of the embodiment of the present disclosure.
Figure 7:
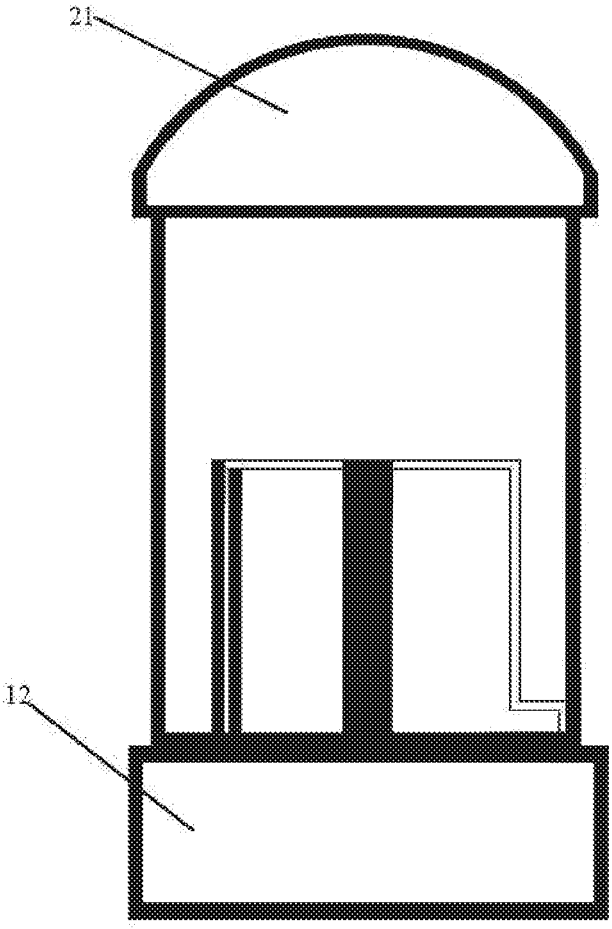
FIG. 7 illustrates a cross-sectional view of the puzzle block comprising the variable colors of the embodiment of the present disclosure when the puzzle block is in a jointed state.
Figure 8:
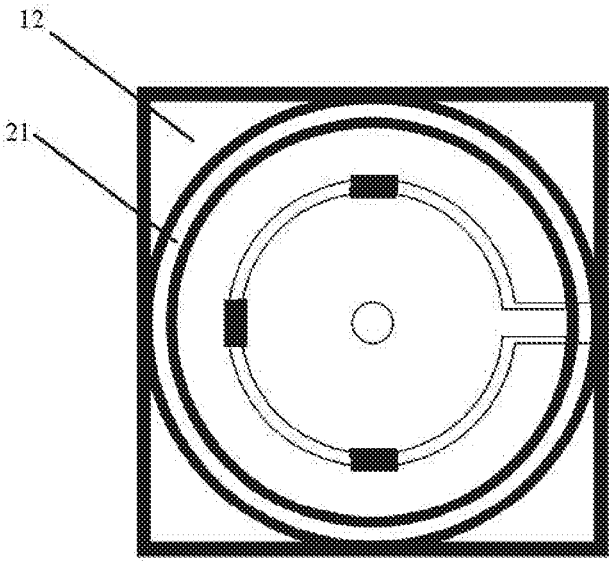
FIG. 8 illustrates a bottom view of the puzzle block comprising variable colors of the embodiment of the present disclosure when the puzzle block is in the jointed state.
Figure 9:
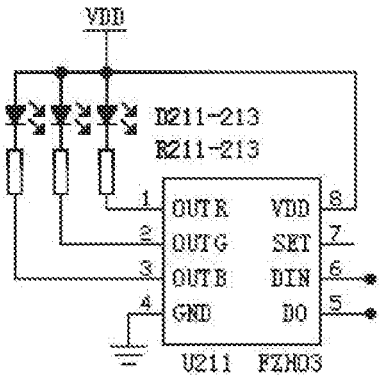
FIG. 9 illustrates a circuit diagram of the puzzle block comprising the variable colors of the embodiment of the present disclosure.
Figure 10:
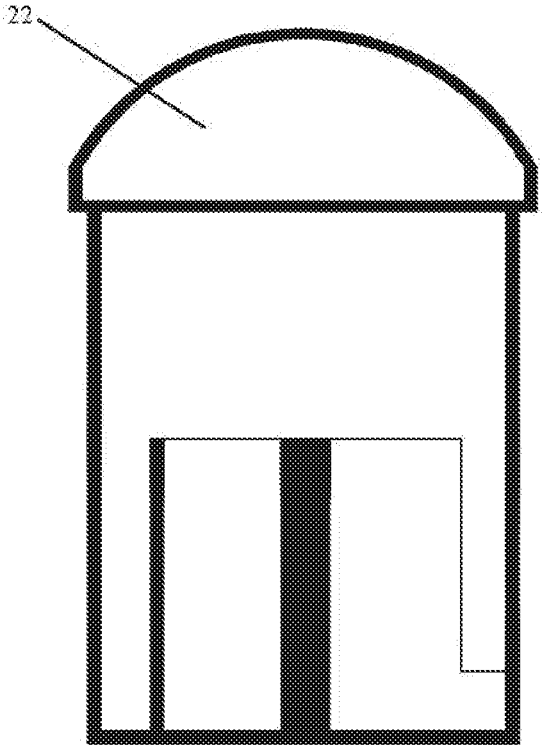
FIG. 10 illustrates a cross-sectional view of a puzzle block comprising a constant color of the embodiment of the present disclosure.
Figure 11:
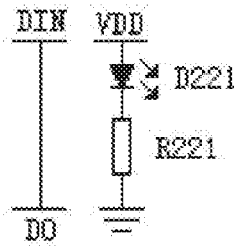
FIG. 11 illustrates a circuit diagram of the puzzle block comprising the constant color of the embodiment of the present disclosure.

Referring to FIGS. 5 and 6, the plurality of puzzle blocks 20 each comprises an image part 201 and a plug part 202 disposed in a vertical direction, and the plug parts 202 each comprises a second positioning groove 131 corresponding to a corresponding one of the first positioning protrusion columns 122. An inner side wall of each of the second positioning grooves 131 is disposed with a second negative electrode 133, a second control input electrode 132, and a second control output electrode 134. A bottom surface of each of the second positioning grooves 131 is disposed with a second positioning protrusion column 135 corresponding to a corresponding one of the first positioning grooves 126, and each of the second positioning protrusion columns 135 is disposed with a second positive electrode 136. The second positioning grooves 131 each comprises a positioning opening 137 corresponding to a corresponding one of the positioning protrusions 121, and the plurality of puzzle blocks can be connected to the puzzle base 1 through the plurality of joint interfaces 12. The first negative electrode 123 contacts the second negative electrode 133, the first control output electrode 125 contacts the second control output electrode 134, the first control input electrode 124 contacts the second control input electrode 132, and the first positive electrode 127 contacts the second positive electrode 136 to achieve power supply and signal transmission.

In this embodiment, the plurality of puzzle blocks 20 comprise one or more light-emitting puzzle blocks, a wind generating puzzle block 23, a smell generating puzzle block 24, a rain generating puzzle block 25, a tree puzzle block 26, a lightning and thunder generating puzzle block 27, one or more person puzzle blocks, one or more animal puzzle blocks, and a general extension puzzle block 29.

Referring to FIGS. 5-11, the one or more light-emitting puzzle blocks comprise a puzzle block comprising a constant color 22 and a puzzle block comprising variable colors 21. The puzzle block comprising the constant color 22 comprises a light emitting diode (LED) lamp D221. The puzzle block comprising the variable colors 21 comprises first three-primary-color LED lamps D211-213 and a LED drive module U211. The LED drive module U211 controls the first three-primary-color LED lamps D211-213 to emit light comprising various colors.

Figure 12:
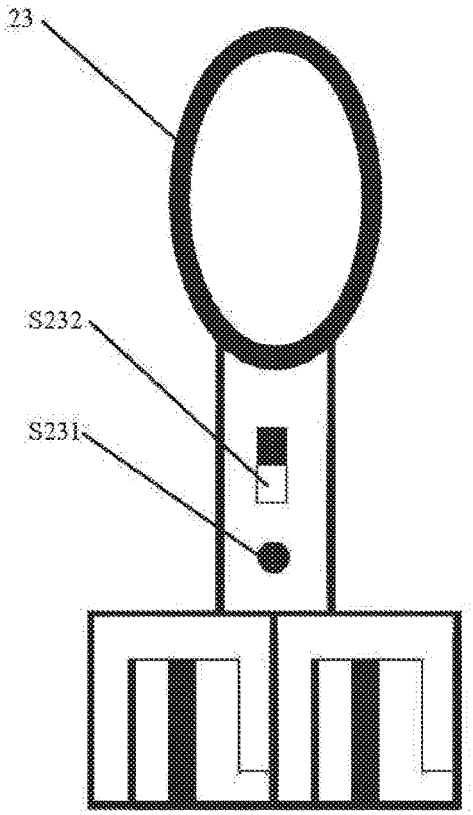
FIG. 12 illustrates a cross-sectional view of a wind generating puzzle block of the embodiment of the present disclosure.
Figure 13:
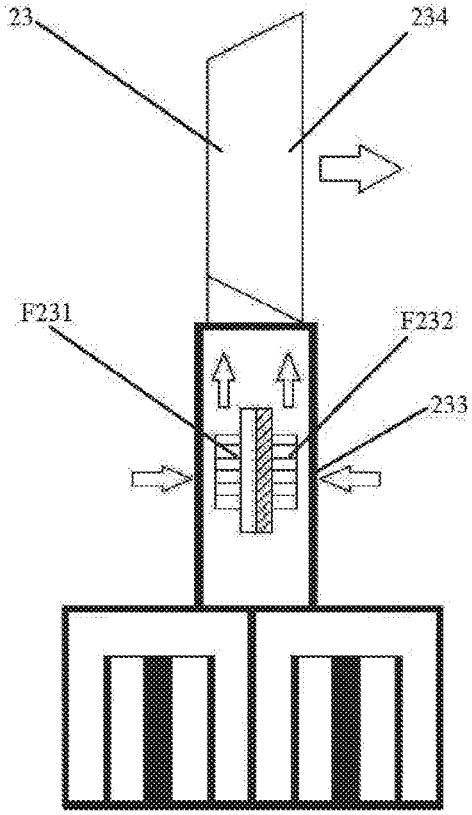
FIG. 13 illustrates a schematic view of an internal structure of the wind generating puzzle block of the embodiment of the present disclosure.
Figure 14:
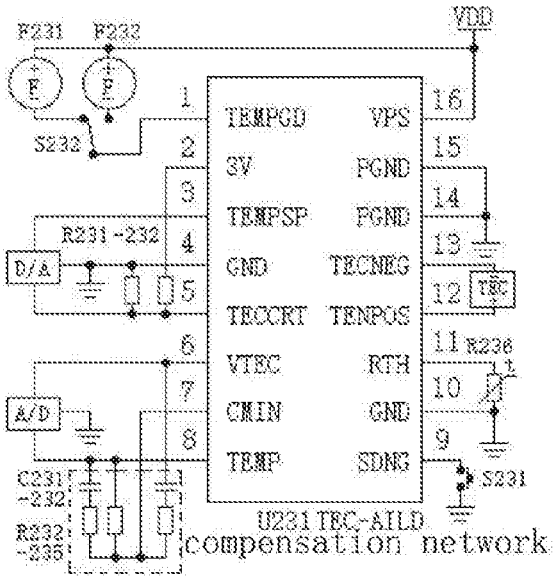
FIG. 14 illustrates a circuit diagram of the wind generating puzzle block of the embodiment of the present disclosure.

Referring to FIGS. 12-14, the wind generating puzzle block 23 comprises first fans, and the first fans are used to simulate natural wind. An inner side of the wind generating puzzle block 23 is disposed with a TEC-AILD temperature control chip U231, an air inlet 233, an air outlet 234, a semiconductor cooler TEC, an adjustment switch 5231, and cold-and-hot selection switches 5232. The semiconductor cooler TEC is disposed between the air inlet 233 and the air outlet 234. The first fans comprise a turbo cool air fan F231 and a turbo hot air fan F232. The turbo cool air fan F231 is disposed on a cold surface of the semiconductor cooler TEC, and the turbo hot air fan F232 is disposed on a hot surface of the semiconductor cooler TEC. The cold-and-hot selection switches 5232 are respectively connected to the turbo cool air fan F231 or the turbo hot air fan F232 to selectively start the turbo cool air fan F231 or the turbo hot air fan F232. A first pin 1 of the TEC-AILD temperature control chip U231 outputs wind speed data to drive the turbo cool air fan F231 and the turbo hot air fan F232. A second pin 2 of the TEC-AILD temperature control chip U231 is a 3 volt (V) regulated voltage output. A third pin 3, a fourth pin 4, and a fifth pin 5 of the TEC-AILD temperature control chip U231 define a digital to analog conversion network for digital conversion. A sixth pin 6, a seventh pin 7, and an eighth pin 8 of the TEC-AILD temperature control chip U231 and a compensation network define an analog to digital conversion network for semiconductor cooler TEC control. The ninth pin 9 of the TEC-AILD temperature control chip U231 is connected to the adjustment switch 5231 for receiving a temperature adjustment input. A tenth pin 10 and an eleventh pin 11 of the TEC-AILD temperature control chip U231 are connected to a temperature detection thermistor R236. A twelfth pin 12 and a thirteenth pin 13 of the TEC-AILD temperature control chip U231 are connected to the semiconductor cooler TEC for drive output of the semiconductor cooler TEC, and a sixteenth pin 16 of the TEC-AILD temperature control chip U231 is connected to a 5V power supply.

Figure 15:
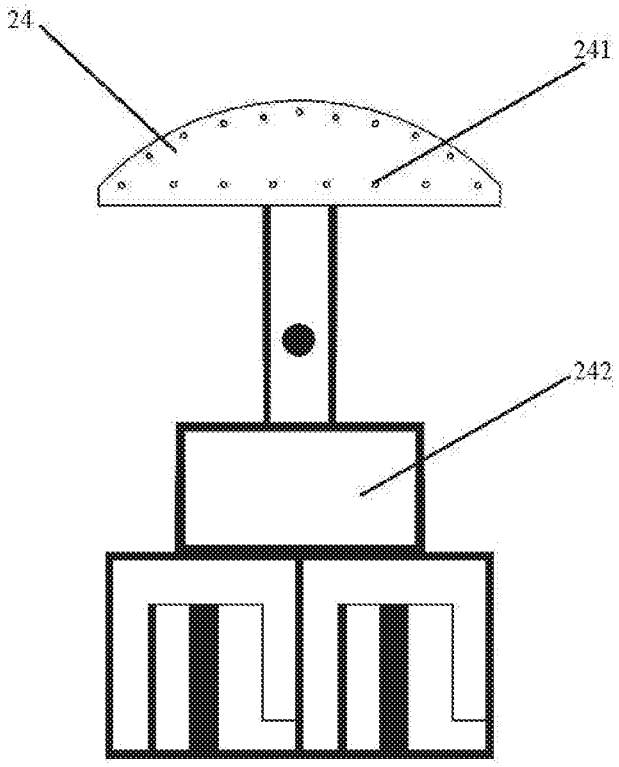
FIG. 15 illustrates a cross-sectional view of a smell generating puzzle block of the embodiment of the present disclosure.

Referring to FIG. 15, an inner side of the smell generating puzzle block 24 comprises a spice groove 242 for storing spices, and an outer side of the smell generating puzzle block 24 comprises a first atomizing nozzle 241 connected to the spice groove 242. The first atomizing nozzle 241 is used to spray the spices.

Figure 16:
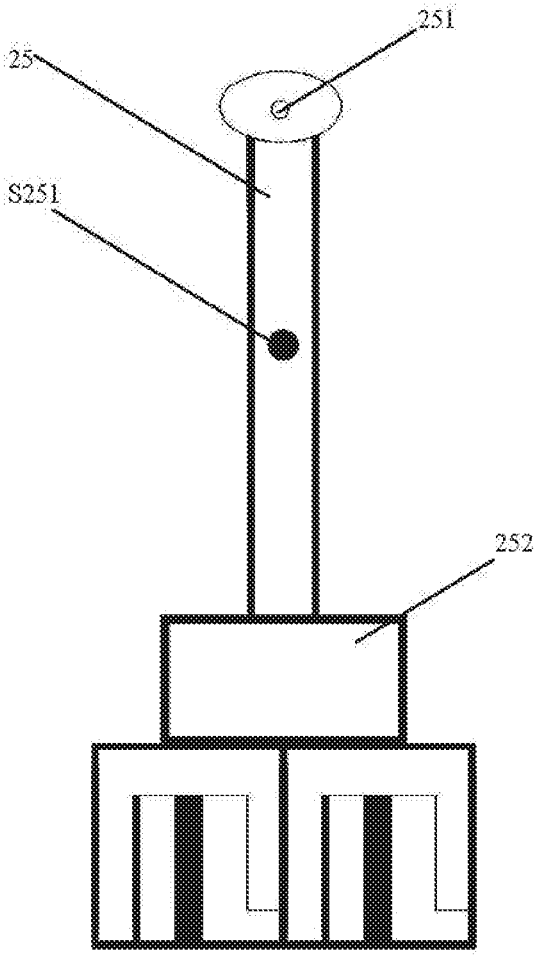
FIG. 16 illustrates a cross-sectional view of a rain generating puzzle block of the embodiment of the present disclosure.
Figure 17:
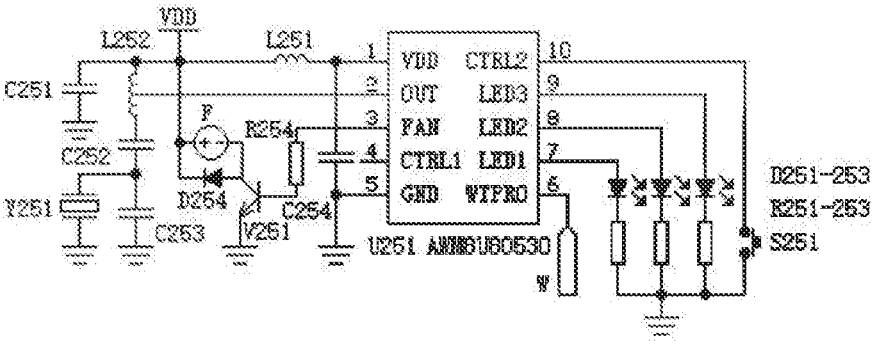
FIG. 17 illustrates a circuit diagram of the rain generating puzzle block of the embodiment of the present disclosure.

Referring to FIGS. 16 and 17, an inner side of the rain generating puzzle block 25 comprises a water groove 252, an outer side of the rain generating puzzle block 25 comprises a second atomizing nozzle 251 connected to the water groove 252. The second atomizing nozzle 251 is used to simulate rain. An internal chip of the rain generating puzzle block 25 is a AWM8U80530 ultrasonic atomizer control chip U251. A first pin 1 of the ultrasonic atomizer control chip U251 is connected to a power supply, and a second pin 2 of the ultrasonic atomizer control chip U251 is an open collector (OC) output of an internal power tube end connected to an ultrasonic oscillator Y251 to atomize water. A third pin 3 of the ultrasonic atomizer control chip U251 is a fan control output terminal configured to be connected to a second fan F to spray the atomized water through the second atomizing nozzle 251. A fourth pin 4 of the ultrasonic atomizer control chip U251 is for switching, and a fifth pin 5 of the ultrasonic atomizer control chip U251 is grounded. A sixth pin 6 of the ultrasonic atomizer control chip U251 is a water level detection input terminal configured to be connected to a water level prober W to detect a water level of the water groove 252. A seventh pin 7, an eighth pin 8, and a ninth pin 9 of the ultrasonic atomizer control chip U251 are LED outputs. A tenth pin 10 of the ultrasonic atomizer control chip U251 is connected to a mode switch 5251 configured to adjust spray intensity.

Figure 18:
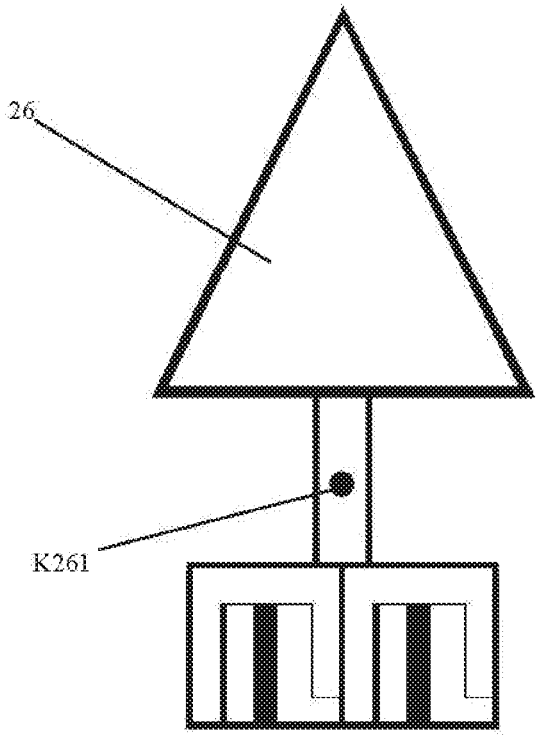
FIG. 18 illustrates a cross-sectional view of a tree puzzle block of the embodiment of the present disclosure.
Figure 19:
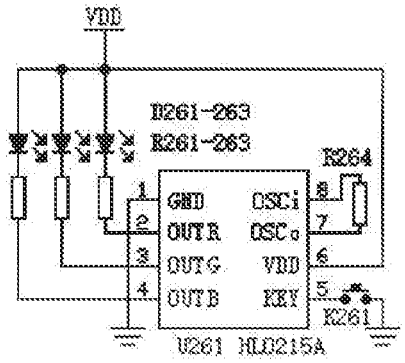
FIG. 19 illustrates a circuit diagram of the tree puzzle block of the embodiment of the present disclosure.

Referring to FIGS. 18 and 19, the tree puzzle block 26 comprises a light-transmissive tree-shaped shell. An inner side of the light-transmissive tree-shaped shell is disposed with second three-primary-color LED lamps D261-263, a gradient LED drive module U261, and a season selection switch K261. The gradient LED drive module U261 controls a light color of light emitted by the second three-primary-color LED lamps D261-263 to change gradually to simulate changes of trees in different seasons. The season selection switch K261 is connected to an input terminal of the gradient LED drive module U261 to control an initial color of the second three-primary-color LED lamps D261-263 to achieve a season selection.

A difference between the smell generating puzzle block 24 and the rain generating puzzle block 25 is that atomizing materials are different.

Figure 20:
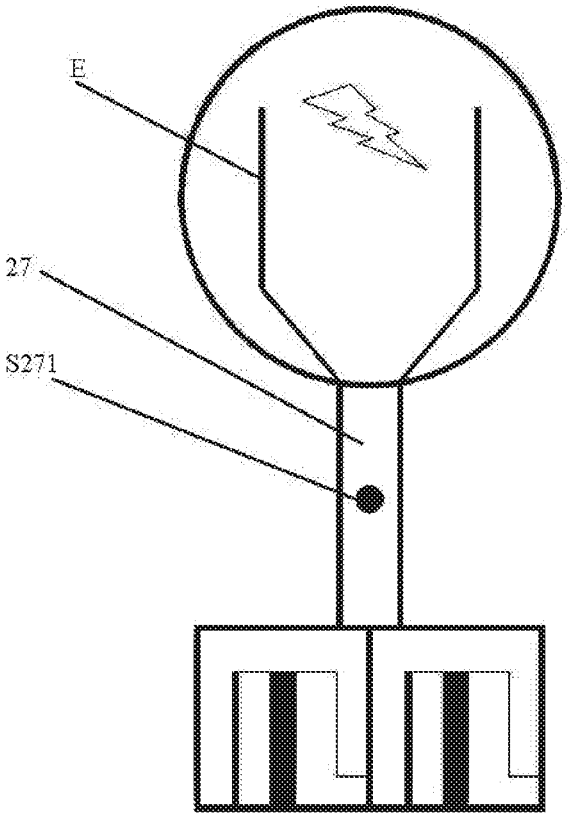
FIG. 20 illustrates a cross-sectional view of a lightning and thunder generating puzzle block of the embodiment of the present disclosure.
Figure 21:
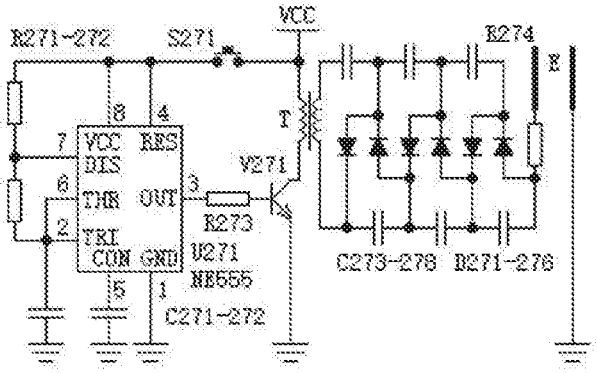
FIG. 21 illustrates a circuit diagram of the lightning and thunder generating puzzle block of the embodiment of the present disclosure.
Figure 22:
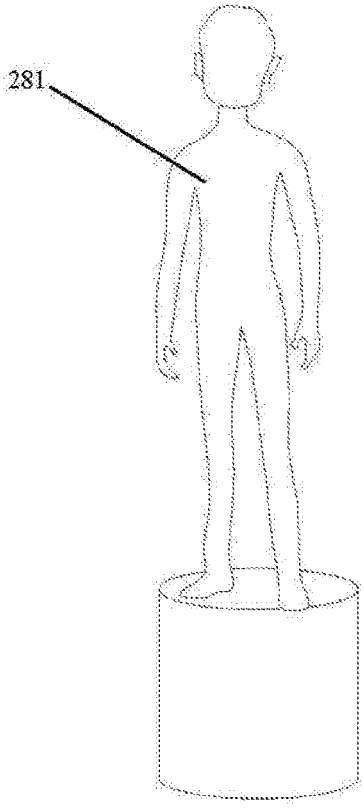
FIG. 22 illustrates a perspective view of a three-dimensional male puzzle block of the embodiment of the present disclosure.
Figure 23:
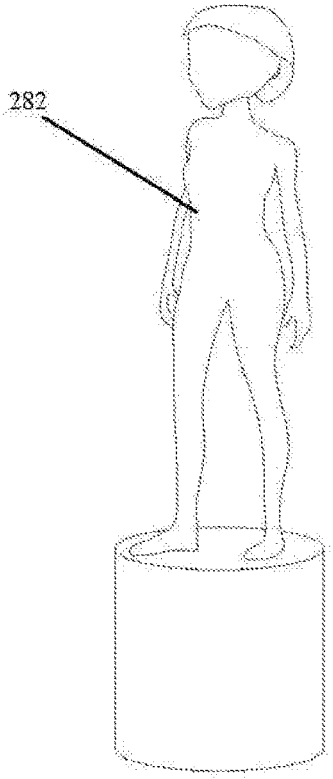
FIG. 23 illustrates a perspective view of a three-dimensional female puzzle block of the embodiment of the present disclosure.
Figure 24:
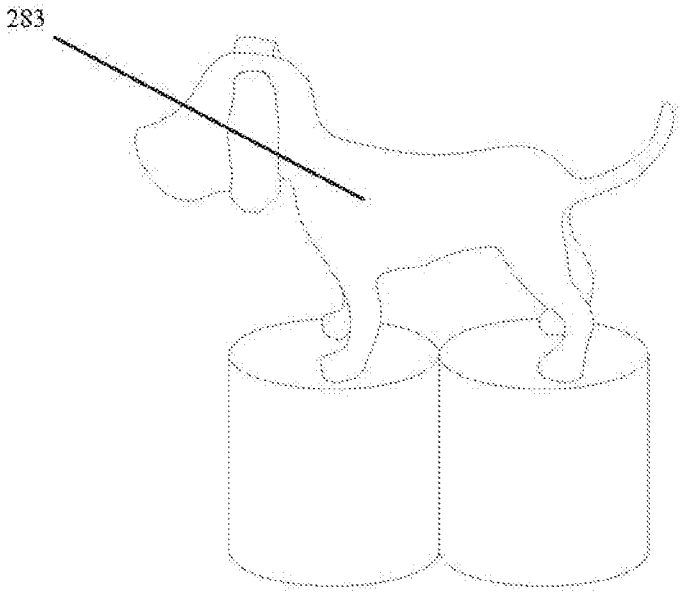
FIG. 24 illustrates a perspective view of a puppy puzzle block of the embodiment of the present disclosure.
Figure 25:
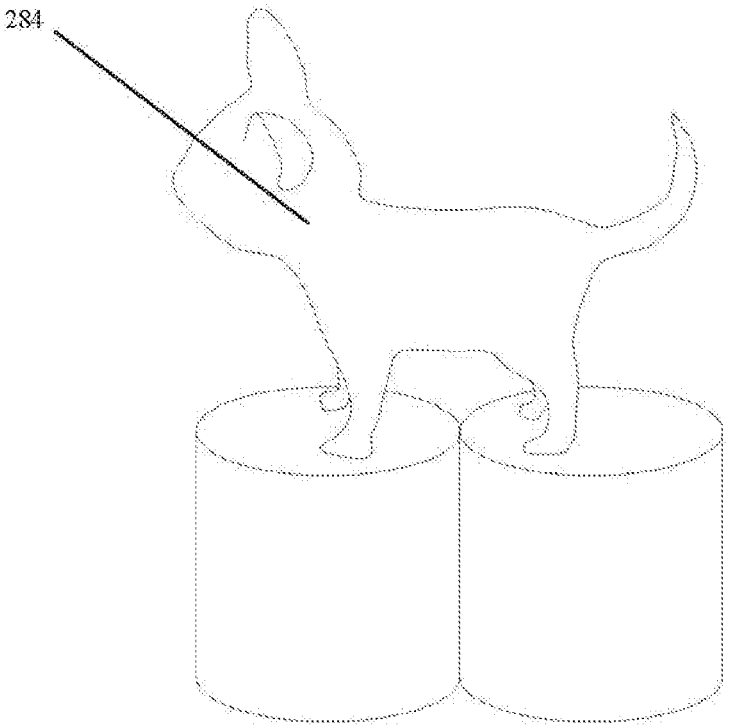
FIG. 25 illustrates a perspective view of a kitten puzzle block of the embodiment of the present disclosure.

Referring to FIGS. 20 and 21, the lightning and thunder generating puzzle block 27 comprises an electric discharge switch 5271 and an electric discharge electrode E (e.g., a high-voltage electric discharge electrode). The electric discharge switch 5271 controls the electric discharge electrode E to discharge electricity to simulate lightning and thunder. The lightning and thunder generating puzzle block 27 is disposed with an NE555 time base chip U271 (e.g., a 555 timer) and a step-up transformer. The NE555 time base chip U271, resistors R271-273, and capacitors C271-272 define a multivibrator, and capacitors C273-278 and diodes D271-276 define a voltage-multiplier and rectifier circuit. An output terminal of the 555 timer is connected to an input terminal of the step-up transformer, an output terminal of the step-up transformer is connected to an input terminal of the voltage-multiplier and rectifier circuit, and an output terminal of the voltage-multiplier and rectifier circuit is connected to the electric discharge electrode E to discharge electricity. The electric discharge electrode E is surrounded by a transparent safety cover, and the electric discharge switch 5271 controls the electric discharge electrode E to discharge electricity.

Referring to FIGS. 22-25, the one or more person puzzle blocks each comprises a light-transmitting person-shaped shell (281 or 282) and a second LED lamp disposed in the light-transmitting person-shaped shell. The one or more person puzzle blocks comprise a three-dimensional male puzzle block 281 with a male-shaped shell and a three-dimensional female puzzle block 282 with a female-shaped shell. The one or more animal puzzle blocks each comprises a light-transmitting animal-shaped shell (283 or 284) and a third LED lamp disposed in the light-transmitting animal-shaped shell. The one or more animal puzzle blocks comprise a puppy puzzle block 283 with a puppy-shaped shell and a kitten puzzle block 284 with a kitten-shaped shell. Internal circuits of the one or more person puzzle blocks and the one or more animal puzzle blocks are the same as the puzzle block comprising the constant color 22, and the one or more person puzzle blocks and the one or more animal puzzle blocks are used to simulate a position distribution of people and animals in the natural environment.

Figure 26:
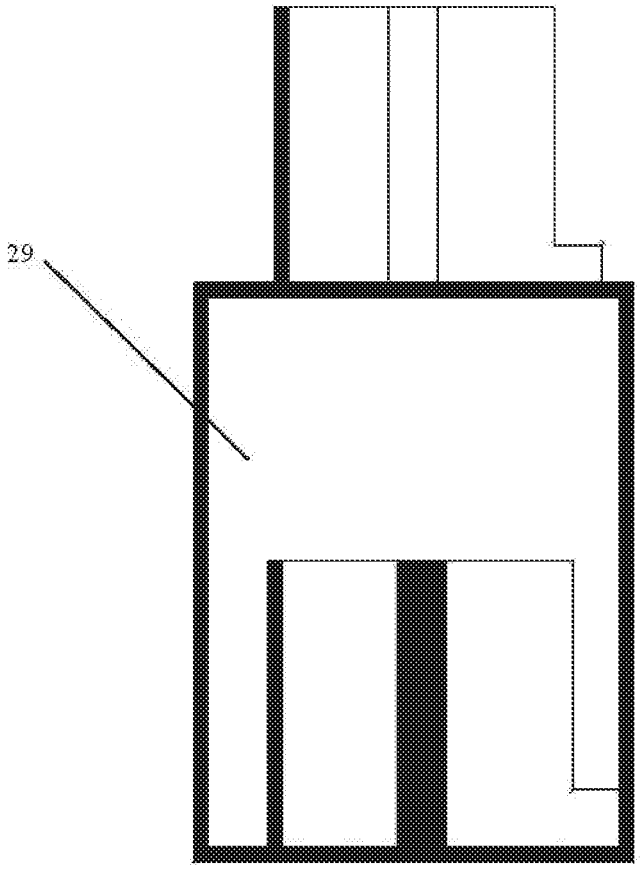
FIG. 26 illustrates a cross-sectional view of a general extension puzzle block of the embodiment of the present disclosure.
Figure 27:
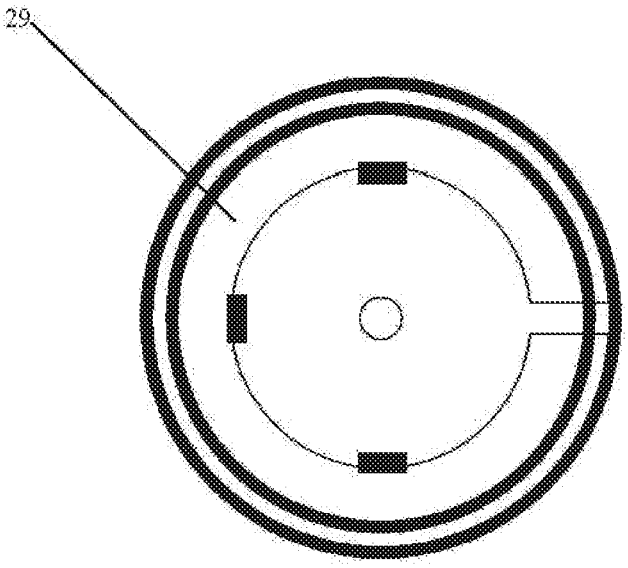
FIG. 27 illustrates a bottom view of the general extension puzzle block of the embodiment of the present disclosure.
Figure 28:
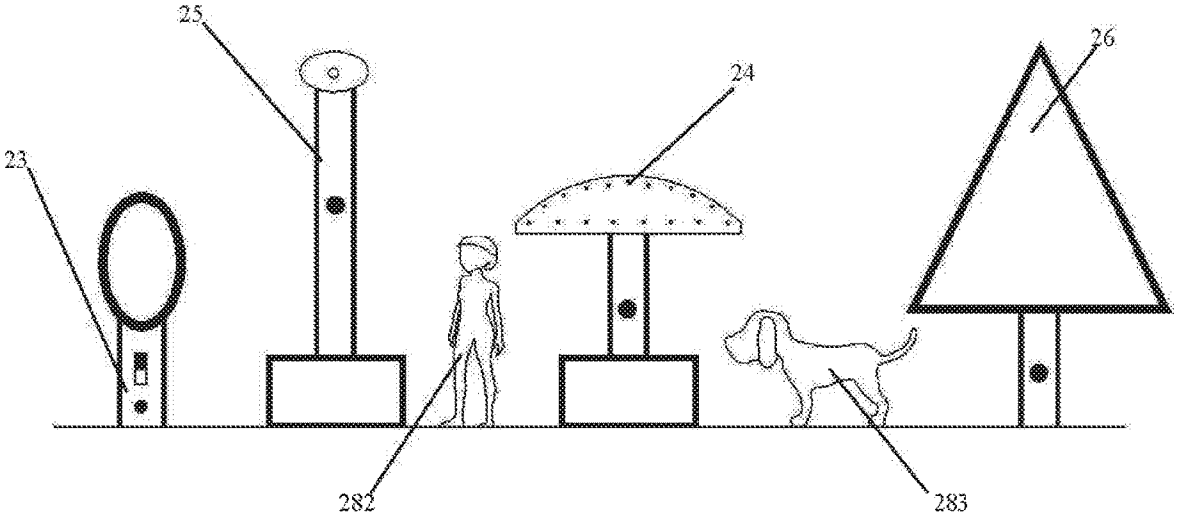
FIG. 28 illustrates a front view of the embodiment of the present disclosure where puzzle blocks are assembled to the puzzle base.

Referring to FIGS. 26 and 27, the general extension puzzle block 29 can also be jointed to other puzzle blocks for extension functions to achieve vertical extension joints.

In this embodiment, the puzzle block comprising variable colors 21 is jointed to the puzzle base 1 to receive graphic codes generated by the Bluetooth control module U1, and the LED drive module U211 controls the first three-primary-color LED lamps D211-213 to display different colors so as to display different graphics (different colors) according to the graphic codes. The puzzle blocks comprising variable colors 21 can be replaced with other puzzle blocks to simulate different natural scenes.

In this embodiment, the plurality of puzzle blocks 20 are designed according to sizes of the image parts thereof. The plug part of each of the plurality of puzzle blocks 20 can be a single plug, in this embodiment, such as the puzzle block comprising the constant color 22, the puzzle block comprising the variable colors 21, the three-dimensional male puzzle block 281, and the three-dimensional female puzzle block 282, and the general extension puzzle block 29. The plug part of each of the plurality of puzzle blocks 20 can also be double plugs or multiple plugs, in this embodiment, such as the wind generating puzzle block 23, the smell generating puzzle block 24, the rain generating puzzle block 25, the tree puzzle block 26, the lightning and thunder generating puzzle block 27, the puppy puzzle block 283, and the kitten puzzle block 284.

This embodiment is used as follows. The puzzle base 1 is connected to a smart device, such as a computer, a mobile phone, a tablet, or etc. through a USB interface 13 or Bluetooth. In this embodiment, the somatosensory electronic puzzle further comprises other puzzle blocks comprising variable colors 21. The puzzle block comprising variable colors 21 and the other puzzle blocks comprising variable colors 21 define a plurality of puzzle blocks comprising variable colors 21. At least some of the plurality of puzzle blocks comprising variable colors 21 are jointed to the puzzle base 1 through the plurality of joint interfaces 12. The function selection switch 11 is in a receiving state, the smart device is used to generate a scene, and a graphic code of the generated scene is copied to the puzzle base 1. The plurality of puzzle blocks comprising variable colors 21 emit light according to the graphic code to obtain a dynamic LED scene. At the same time, the audio module U2 cooperates with the dynamic LED scene for voice description, and then some of the plurality of puzzle blocks comprising variable colors 21 are removed from the puzzle base 1, and other puzzle blocks are used to replace the removed puzzle blocks comprising variable colors 21 according to the scene, imagination, and creativity, so that a planar puzzle is changed to a three-dimensional puzzle to enable better puzzle creation. For example, the puzzle block comprising the constant color 22 is used to mark a specific scene, such as a water reef, lighthouse, and a land mountain peak. The wind generating puzzle block 23 is used to simulate a wind direction and a wind speed in different seasons, such as southeast wind in the northern hemisphere being hot and northwest wind being cold. The smell generating puzzle block 24 is used to simulate different flower scents or fruit scents. The rain generating puzzle block 25 is used to simulate rain weather phenomenon. The rain generating puzzle block 25 cooperates with the lightning and thunder generating puzzle block 27 to simulate thunderstorms. The rain generating puzzle block 25 cooperates with the wind generating puzzle block 23, and the atomized water meets cold wind generated by the wind generating puzzle block 23 to generate snowflakes to simulate snowy weather. The tree puzzle block 26 is used to simulate tree growth states in four seasons. The one or more person puzzle blocks and the one or more animal puzzle blocks are used to simulate a distribution of people and animals in the natural environment, such as people living in cities and plains and animals living mountains and forests.

In addition, teachers and parents can set specific scenes through the plurality of puzzle blocks comprising variable colors 21 and other puzzle blocks, and then some other puzzle blocks are provided to observe how a child combines puzzle blocks to detect the child's cognitive status and mental health status. The child's cognitive status comprises, but is not limited to, a relationship between humans and plants, a relationship between humans and animals, a relationship between humans, etc.

It will be apparent to those skilled in the art that various modifications and variation can be made in the present disclosure without departing from the spirit or scope of the invention. Thus, it is intended that the present disclosure cover the modifications and variations of this invention provided they come within the scope of the appended claims and their equivalents.

What is claimed is:

1. A somatosensory electronic puzzle, comprising:

a puzzle base, and a plurality of puzzle blocks, wherein:

the plurality of puzzle blocks are detachably connected to the puzzle base, the puzzle base comprises a bottom plate and a frame, an inner side of the frame is disposed with a control module and a storage module for storing a graphic code, an outer surface of the frame is disposed with a function selection switch, the function selection switch is connected to an input terminal of the control module, the plurality of puzzle blocks comprise a combination of one or more light-emitting puzzle blocks, a wind generating puzzle block, a smell generating puzzle block, a rain generating puzzle block, a tree puzzle block, a lightning and thunder generating puzzle block, a person puzzle block, or an animal puzzle block, the one or more light-emitting puzzle blocks comprise a puzzle block comprising a constant color and a puzzle block comprising variable colors, the puzzle block comprising the constant color comprises a first light emitting diode (LED) lamp, the puzzle block comprising variable colors comprises first three-primary-color LED lamps and an LED drive module, the LED drive module controls the first three-primary-color LED lamps, the wind generating puzzle block comprises one or more first fans, an inner side of the smell generating puzzle block is disposed with a spice groove for storing spices, an outer side of the smell generating puzzle block is disposed with a first atomizing nozzle connected to the spice groove, an inner side of the rain generating puzzle block is disposed with a water groove for storing water, an outer side of the rain generating puzzle block is disposed with a second atomizing nozzle connected to the water groove, the tree puzzle block comprises a light-transmissive tree-shaped shell, an inner side of the light-transmissive tree-shaped shell is disposed with second three-primary-color LED lamps and a gradient LED drive module, the gradient LED drive module is connected to the second three-primary-color LED lamps, the lightning and thunder generating puzzle block comprises an electric discharge switch and an electric discharge electrode, the electric discharge switch controls the electric discharge electrode to discharge electricity to simulate lightning and thunder, the person puzzle block comprises a light-transmitting person-shaped shell and a second LED lamp disposed in the light-transmitting person-shaped shell, the animal puzzle block comprises a light-transmitting animal-shaped shell and a third LED lamp disposed in the light-transmitting animal-shaped shell, the puzzle base comprises a plurality of joint interfaces, the plurality of joint interfaces each comprises a first positioning protrusion column comprising a positioning protrusion, an outer side wall of the first positioning protrusion column is disposed with a first negative electrode, a first control input electrode, and a first control output electrode, a top end surface of the first positioning protrusion column comprises a first positioning groove, a first positive electrode is disposed in the first positioning groove, the plurality of puzzle blocks each comprises a second positioning groove corresponding to a corresponding one of the first positioning protrusion columns, an inner side wall of each of the second positioning grooves is disposed with a second negative electrode, a second control input electrode, and a second control output electrode, a bottom surface of each of the second positioning grooves is disposed with a second positioning protrusion column corresponding to a corresponding one of the first positioning grooves, a second positive electrode is disposed on the second positioning protrusion column, the second positioning grooves each comprises a positioning opening corresponding to a corresponding one of the positioning protrusions, the plurality of puzzle blocks is connected to the puzzle base through the plurality of joint interfaces, and the first negative electrode contacts the second negative electrode, the first control output electrode contacts the second control output electrode, the first control input electrode contacts the second control input electrode, and the first positive electrode contacts the second positive electrode to achieve at least one of power supply or signal transmission.

2. The somatosensory electronic puzzle according to claim 1, wherein:

the puzzle base further comprises an audio module, and the control module drives the audio module to play audio.

3. The somatosensory electronic puzzle according to claim 1, wherein:

the control module is a Bluetooth chip with a universal serial bus (USB) interface, and the Bluetooth chip is configured to be connected to an external device through the USB interface or Bluetooth to update the graphic code.

4. The somatosensory electronic puzzle according to claim 1, wherein:

the wind generating puzzle block further comprises an air inlet, an air outlet, a temperature control chip, a semiconductor cooler, an adjustment switch, and cold-and-hot selection switches, the semiconductor cooler is disposed between the air inlet and the air outlet, the one or more first fans comprise a cool air fan and a hot air fan, the temperature control chip drives the semiconductor cooler, the cool air fan is disposed on a cold surface of the semiconductor cooler, the hot air fan is disposed on a hot surface of the semiconductor cooler, the adjustment switch is connected to the temperature control chip for temperature adjustment, and the cold-and-hot selection switches are respectively connected to the cool air fan and the hot air fan.

5. The somatosensory electronic puzzle according to claim 1, wherein:

the inner side of the smell generating puzzle block is disposed with a first atomizer, the inner side of the rain generating puzzle block is disposed with a second atomizer, the first atomizer atomizes the spices to generate atomized spices, the second atomizer atomize the water to generate atomized water, the atomized spices spray out of the first atomizing nozzle using a second fan, and the atomized water sprays out of the second atomizing nozzle using the second fan.

6. The somatosensory electronic puzzle according to claim 1, wherein:

the lightning and thunder generating puzzle block further comprises a 555 timer, a step-up transformer, and a voltage-multiplier and rectifier circuit, the 555 timer defines a multivibrator, an output terminal of the 555 timer is connected to an input terminal of the step-up transformer, an output terminal of the step-up transformer is connected to an input terminal of the voltage-multiplier and rectifier circuit, and an output terminal of the voltage-multiplier and rectifier circuit is connected to the electric discharge electrode to discharge electricity.

7. The somatosensory electronic puzzle according to claim 1, wherein:

the lightning and thunder generating puzzle block further comprises a transparent safety cover, and the transparent safety cover surrounds the electric discharge electrode.

8. The somatosensory electronic puzzle according to claim 1, wherein:

the tree puzzle block further comprises a season selection switch, and the season selection switch is connected to an input terminal of the gradient LED drive module to control an initial color of the second three-primary-color LED lamps.

9. The somatosensory electronic puzzle according to claim 1, wherein:

the plurality of puzzle blocks each comprises an image part and a plug part disposed in a vertical direction, the image part is light-emitting parts of the one or more light-emitting puzzle blocks, a wind generating part of the wind generating puzzle block, a smell generating part of the smell generating puzzle block, a rain generating part of the rain generating puzzle block, a tree-image part of the tree puzzle block, a lightning and thunder generating part of the lightning and thunder generating puzzle block, a person image part of the person puzzle block, or an animal image part of the animal puzzle block, the plug parts each cooperates with a corresponding one of the joint interfaces, and the plug parts each comprises a corresponding one of the second positioning grooves.

10. The somatosensory electronic puzzle according to claim 9, wherein the plurality of puzzle blocks each comprises a single plug part or two or more plug parts.

11. The somatosensory electronic puzzle according to claim 1, wherein the plurality of puzzle blocks further comprise a general extension block.

12. The somatosensory electronic puzzle according to claim 1, wherein a shaft center of the top end surface of the first positioning protrusion column comprises the first positioning groove.

* * * * *